United States Patent [19]

Tanino et al.

[11] Patent Number: 4,635,532

[45] Date of Patent: Jan. 13, 1987

[54] SPEEDUP DEVICE FOR HYDRAULIC CONTROL CIRCUIT SYSTEMS

[75] Inventors: Masahiro Tanino; Tomoyuki Higuchi, both of Itami, Japan

[73] Assignee: Sanyo Kiki Kabushiki Kaisha, Hyogo, Japan

[21] Appl. No.: 308,905

[22] Filed: Oct. 5, 1981

Related U.S. Application Data

[63] Continuation-in-part of Ser. No. 182,073, Aug. 28, 1980.

[51] Int. Cl.[4] ..... F15B 11/08

[52] U.S. Cl. ..... 91/436; 91/437

[58] Field of Search ..... 91/436, 437, 438, 452

[56] References Cited

U.S. PATENT DOCUMENTS

| | | | |
|---|---|---|---|
| Re. 25,643 | 9/1964 | Strader | 91/436 |
| 2,729,224 | 1/1956 | Stueland | 91/436 |
| 3,654,835 | 4/1972 | Sievenpiper | 91/436 |
| 4,194,436 | 3/1980 | Imada | 91/436 |
| 4,249,569 | 2/1981 | Budzich | 91/436 |

FOREIGN PATENT DOCUMENTS

| | | | |
|---|---|---|---|
| 74377 | 12/1944 | Czechoslovakia | 91/520 |
| 1176987 | 4/1959 | France | 91/520 |
| 863701 | 3/1961 | United Kingdom | 91/436 |
| 1141416 | 1/1969 | United Kingdom | 91/436 |

*Primary Examiner*—Abraham Hershkovitz

*Attorney, Agent, or Firm*—Armstrong, Nikaido, Marmelstein & Kubovcik

[57] ABSTRACT

A speedup device or valve means comprises a check-valve disposed in an oil passage connected with the rod-end chamber of a double-acting cylinder for preventing working oil from returning toward a tank only, a circulation valve provided in the upstream of said check valve, said circulation valve being usually urged by a spring to block communication between the oil passages connected with the rod-end and the piston-end chambers, respectively, said circulation valve being designed to move against the spring so as to connect the oil passages with each other in response to the pressure rise in the return oil from the rod-end chamber when said double-acting cylinder is in its rod-extending motion, causing the return oil from the rod-end chamber to shift into the piston-end chamber through a variable restriction, and a circuit set up in a portion of said circulation valve for allowing a portion of the return oil from the rod-end chamber to return to the tank through a variable restriction and a restriction passage.

1 Claim, 4 Drawing Figures

5
i
ii
10
11
a
b
c
d
12
13
14
14a
15
16
16a
17
18
18a
19
20
21
22
23
24
25
26
m
n 5
i
ii
10
11
a
b
c
d
12
13
14
14a
15
16
16a
17
18
18a
19
20
21
22
23
24
25
26

SPEEDUP DEVICE FOR HYDRAULIC CONTROL CIRCUIT SYSTEMS

CROSS-REFERENCE TO RELATED APPLICATION

This is a continuation-in-part of earlier joint application Ser. No. 182,073 filed with others on Aug. 28, 1980, which discloses the invention herein claimed but does not claim the same except as an element of the combination constituting the subject matter of that application.

BACKGROUND OF THE INVENTION

1. Field of the Invention

This device relates to a speed-up valve and, in particular, it is concerned with a speed-up valve associated with a double-acting cylinder for the purpose of achieving an improved efficiency of operation by increasing the rod-extending speed of the double-acting cylinder.

Generally, it is sometimes desirable that one of the rod-extending motion and the rod-retracting motion of a double-acting cylinder is faster than the other. In case of an agricultural front loader, for example, it may be desirable that the dumping motion is faster than the scooping motion.

2. Description of the Prior Art

To this end, various proposals have been made: Increasing the size of hydraulic pumps and pipings; using a vacuum prevention valve to rapidly discharge the load under its own weight; and arranging a directional control valve in the form of a differential circuit. These proposals, however, have disadvantages in cost, operation and back-pressure rise involved due to pipings and valves used and have not been satisfactory.

SUMMARY OF THE INVENTION

The present invention is designed to eliminate various of said disadvantages of the prior art. As hereinafter more fully described, the device comprises a check valve disposed in an oil passage connected with the rod-end chamber of a double-acting cylinder for preventing oil from returning toward a tank only, a circulation valve provided in the upstream of the check valve, the circulation valve being usually urged by a spring to block communication between the oil passages connected with the rod-end and the piston-end chambers, respectively, the circulation valve being designed to move against the spring so as to connect the oil passage with each other in response to the pressure rise in the return oil from the rod-end chamber when the double-acting cylinder is in its rod-extending motion, causing the return oil from the rod-end chamber to shift into the piston-end chamber through a variable restriction, and a choke set up in a portion of the circulation valve for allowing a portion of the return oil from the rod-end chamber to return to the tank through a variable restriction and a restriction passage. Therefore, there is no need to increase the size of the hydraulic pumps and pipings, and instead, it is only necessary to install the compact speed-up valve integrated in unit-handling between the oil passages of the rod-end and piston-end chambers of the double-acting cylinder, thus contributing to an advantage of inexpensive manufacturing cost. Moreover, a decrease in the flow rate of the working oil supplied from the pump decelerates the rod-extending motion of the double-acting cylinder. Any deliberate stoppage in the course of the travelling route as well as an inching operation of the double-acting cylinder can be performed since the pilot pressure of the circulation valve is derived from the return oil from the rod-end chamber. The full sectional area of the double-acting cylinder is available as the pressure-sensitive area which dominates the force of the rod during the double-acting cylinder is in its rod-extending motion. Since the spool comes to standstill as a differential pressure ceases to exist automatically, chattering can be eliminated.

BRIEF DESCRIPTION OF THE DRAWINGS

In the accompanying drawings illustrative of preferred embodiments of the invention.

The earlier disclosure of the present invention in said application Ser. No. 182,073 is herein incorporated by reference.

DESCRIPTION OF PREFERRED EMBODIMENTS

Figure 1:
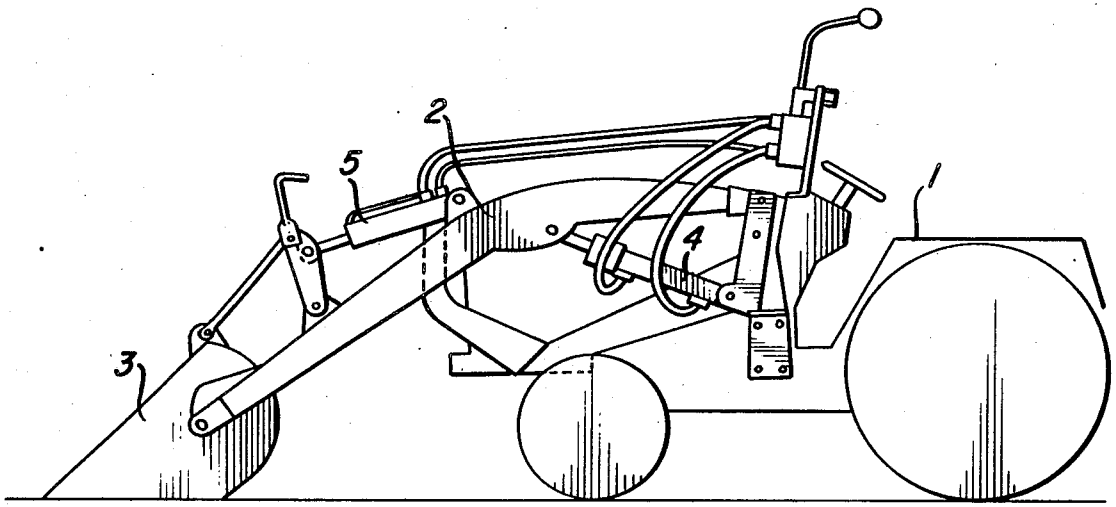
FIG. 1 is a more or less diagrammatic side elevation of a tractor having a front loader to which the present invention is applicable, and corresponds to FIG. 1 of said application Ser. No. 182,073.

In a typical front loader, of the type diagrammatically shown in FIG. 1, a working attachment 3 is mounted at the front end of a lifting arm 2 pivotally supported at the rear end thereof by the main body 1 of a tractor or the like. The lifting arm 2 is associated with a double-acting lifting cylinder 4 for swinging in a vertical plane while the working attachment 3 is rotated in a vertical plane by an associated double-acting dumping cylinder 5.

Figure 2:
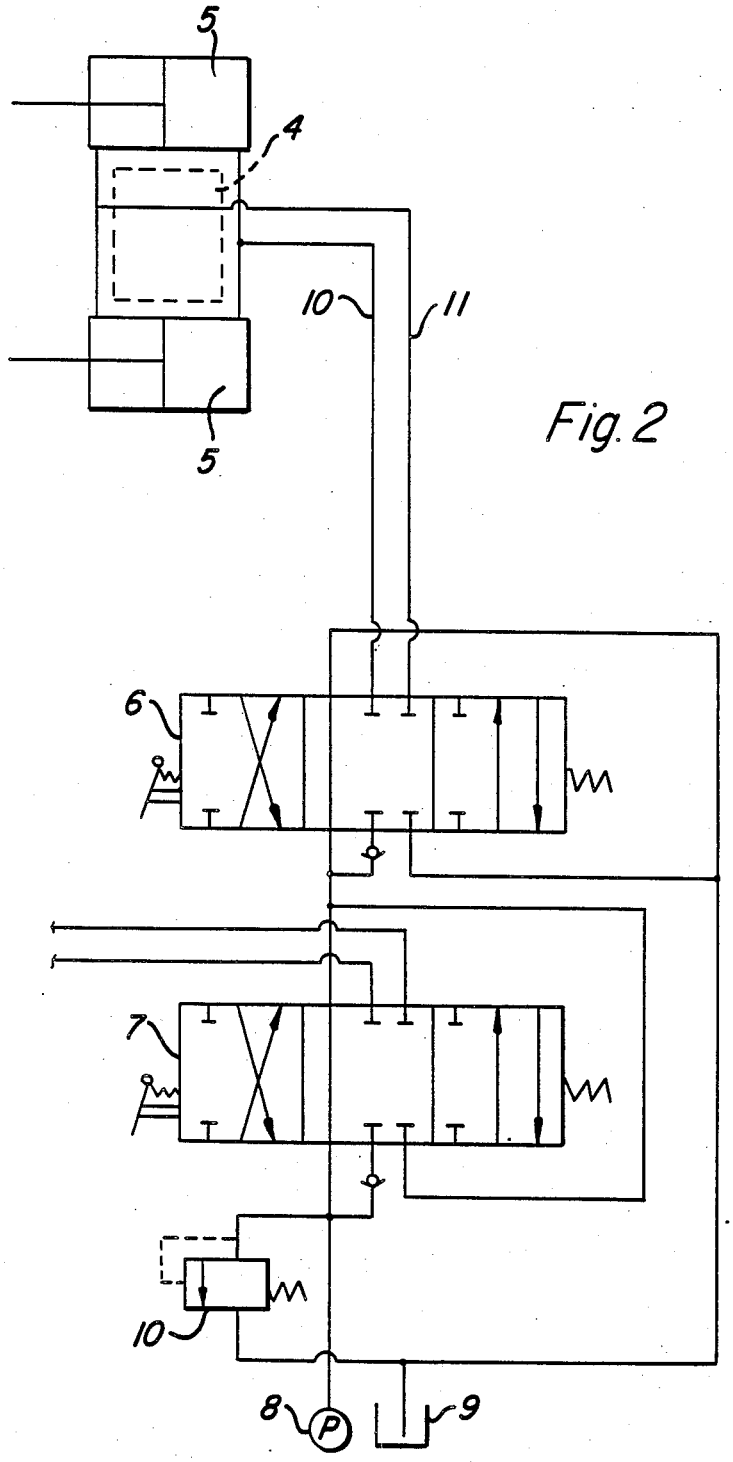
FIG. 2 schematically shows an overall hydraulic control system therefor to which the present speedup device is applied, and corresponds to FIGS. 2 and 10 of said application Ser. No. 182,073 with the lift cylinder thereof not shown.

When such agricultural front loader is in operation, although the speed for scooping the object to be handled, such as crops, offers little problem, the speed for discharging the object thus scooped by the working attachment 3 onto a carrier or the like is desired to be as high as possible so that an increased working efficiency can be attained. In FIG. 2, with cylinder 4 omitted, the numerals 6 and 7 designate directional control valves associated, respectively, with double-acting dumping cylinder 5 and lifting cylinder 4. These control valves control the direction of the working oil from hydraulic pump 8 and the return oil to a tank 9, allowing the respective cylinders to perform the desired functions.

As shown in FIG. 2 as a chain line block, the speed-up valve A embodying the present device, is to be disposed as close as possible to the double-acting cylinder 5.

The detailed construction of the speed-up valve A will be described later.

The mode of operation of the hydraulic control circuit will first be described according to FIG. 2.

The two directional control valves 6 and 7 have three changeover positions, respectively, FIG. 2 showing a state of nonload operation inwhich the control valves are in neutral position and that the working oil from the hydraulic pump 8 returns to the tank 9 via spare ports of the two valves 6 and 7.

If only one of the two valves is individually changed over to its operational position, the cylinder which is associated with the main ports of that valve assumes rod-extending or rod-retracting motion in the desired direction. When the two valves 6 and 7 are to work simultaneously, the cylinder under the control of one of the control valves is activated by the return oil from the cylinder under the control of the other valve. In the embodiment shown in FIG. 2, the double-acting cylinder 5 is supplied the return oil from the lifting cylinder.

The construction of the speed-up valve A will now be described with reference to FIG. 3 et seq.

Figure 3:
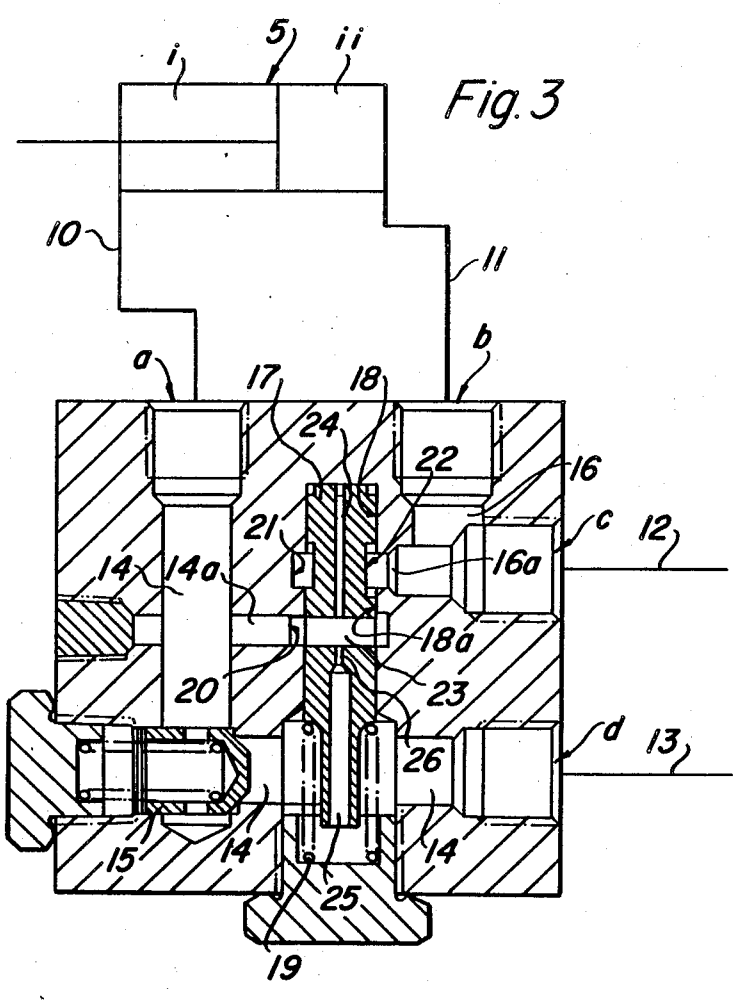

Referring first to FIG. 3, the speed-up valve A is formed in its upper side with a port a connected to the rod-end chamber i of the double-acting cylinder 5 through an oil tube 10 and a port b connected to the piston-end chamber ii through an oil tube 11 and, in its lateral side, with ports c and d connected to two oil tubes 12 and 13 leading from the directional control valves. The ports a and d communicate with each other through an L-shaped oil passage 14 within the main body. A check valve 15 is provided at the bent portion of the L-shaped passage for preventing the working oil from flowing from the port a toward the port d.

The ports b and c communicate with each other through an L-shaped oil passage 16 formed in the main body.

Disposed between the oil passages 14 and 16, is a spool-shaped circulation valve 17 which cooperates with the check valve 15 provided for allowing the return oil during the double-acting cylinder 5 is in its rod-extending motion, that is, the return oil from the rod-end chamber i to shift toward the piston-end chamber ii.

The circulation valve 17 is mounted within a hole 18 for sliding movement therealong, with the hole in parallel with the vertical oil passage of the L-shaped oil passage 14. The circulation valve has its lowermost end facing the horizontal portion of the oil passage 14 and is constantly urged upward by a spring 19.

Branch oil passage 14*a* and 16*a* branched away from the two oil passages 14 and 16 respectively open to the hole 18 for the circulation valve 17 and communicate with annular recesses 20 and 21 formed in the hole 18.

Portion 18*a* of the hole that is in between the two annular recesses 20 and 21 serves as a valve seat which cooperates with an annular communication control recess 22 formed in the outer periphery of the circulation valve 17.

Further, a horizontal through hole 23 is provided in the middle portion of the circulation valve 17 in association with the annular recess 20 of the branch oil passage 14*a* from the rod-end chamber i. A pilot oil passage 24 is provided which axially penetrates the circulation valve 17 with its ends opening to the horizontal through hole 23 and at the uppermost end of the circulation valve 17, respectively. A restriction passage 25 extends from the through hole 23 toward the lowermost end of the circulation valve 17 via a restriction 26.

The circulation valve 17 is usually urged upward by the spring 19 so as to abut against the upper end of the hole 18 with the valve seat 18*a* closed and with the horizontal through hole 23 communicating with the branch oil passage 14*a* (FIG. 3).

In this state, if the double-acting cylinder 5 is to assume its rod-extending motion, the working oil from the hydraulic pump is supplied to the oil pipe 13 via the directional control valve, and the oil pipe 12 is in turn connected to the tank.

As a result, the working oil from the hydraulic pump is supplied into the port a and, forcibly opening the check valve 15, to the rod-end chamber i through the oil passage 14, port a and the oil tube 10. On the other hand, the working oil from the piston-end chamber ii is returned to the tank via the port b, the oil passage 16, port c and the oil tube 12. The rod-retracting motion of the double-acting cylinder 5 is thus effected in an ordinary speed.

Then, as the control valve is changed over so that the working oil from the pump is supplied into the oil tube 12 and the oil tube 13 is connected with the tank, the working oil is supplied into the piston-end chamber ii via the port c, the oil passage 16, the port b and the oil tube 11. On the other hand, the oil in the rod-end chamber i, free running thereof being impeded owing to the check valve 15, can slightly return to the tank by bypassing the check valve via the restriction 26 and restriction passage 25.

Thus, the pressure in the return oil from the rod-end chamber i gradually increases and acts on the upper end of the circulation valve 17 through the pilot oil passage 24 in the direction opposing to the force of spring 19 so as to urge the circulation valve 17 downward.

Figure 4:
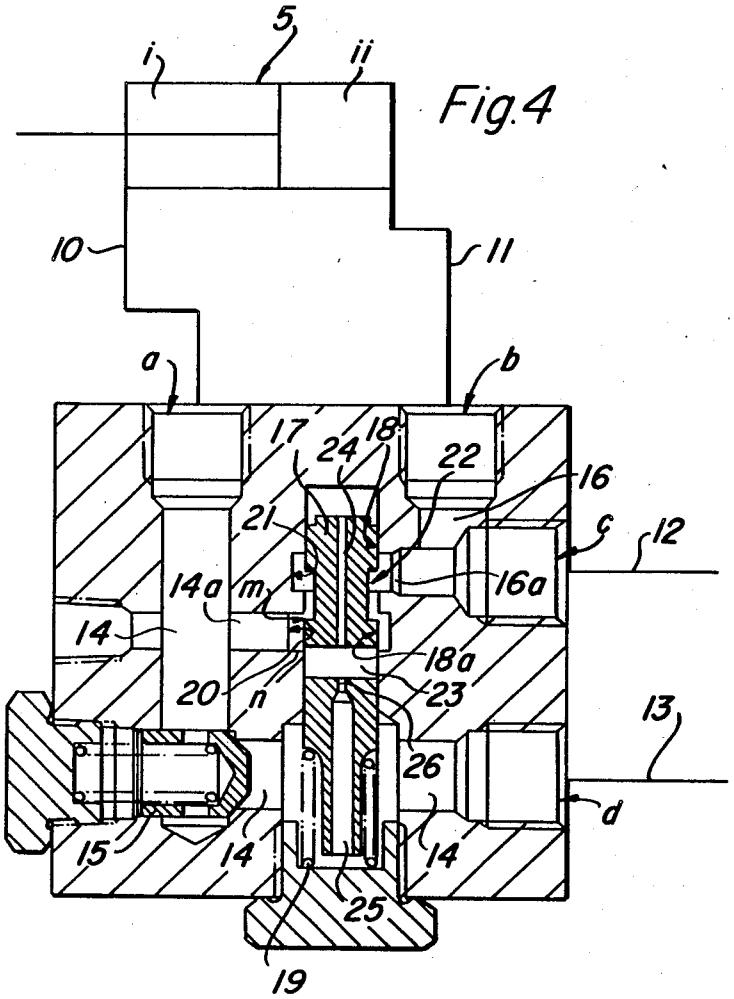
FIGS. 3 and 4 are circuit diagrams showing concrete Examples of the Speedup device, FIG. 3 showing a neutral state and FIG. 4 showing a rod advanced state, and corresponds to FIGS. 11A and 11B of said application Ser. No. 182,073.

At this stage, the two annular recesses 20 and 21 communicate with each other across the valve seat 18*a* through the communication control recess 22 of the circulation valve 17. Consequently, when the double-acting cylinder 5 assumes its rod-extending motion, most of the return oil from the rod-end chamber i is shifted to the piston-end chamber ii while only a portion of the same returns to the tank via the restriction 26 and the restriction passage 25, thereby accelerating the rod-extending motion. In this occasion, the communication control according to the communication control recess 22 of the circulation valve 17 is effected by balancing the pressure in the return oil from the rod-end chamber i with the spring force of the spring 19. As shown in FIG. 4, the circulation valve gets stationary under a state wherein a certain relationship is established between the degree of opening of a variable restriction m defined by the upper edge of the circulation recess 20 and the bottom edge of the communication control recess 22 and the degree of opening of a variable restriction n defined by the bottom edge of the annular recess 20 and the upper edge of the horizontal through hole 23. In other words, since the pilot pressure shall be lot if the degree of opening of the variable restriction n is reduced to zero, there never occurs such a situation wherein the restriction be completely closed. Therefore, if the oil pressure supplied by the hydraulic pump is kept constant and there are no variations in loading, the mutual relationship in the degree of opening between the restrictions m and n is kept constant, causing no chattering.

In addition, the motion of the double-acting cylinder 5 can be brought to a sudden stop by means of choking off the supply of working oil by the directional control valve.

Further, if the rpm of the pump is decreased to reduce the oil supply by means of restricting manipulation of the associated engine, the pressure rise in the return oil from the rod-end chamber i is slackened so as to cause a portion of the oil to turn back toward the tank through the restriction 26 and the restriction passage 25, decelerating the rod-extending motion of the double-acting cylinder 5.

While there have been described herein what are at present considered preferred embodiments of the invention, it will be obvious to those skilled in the art that modifications, including changes, omissions and substitutions, may be made without departing from the essence and principle of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. A speedup device, in a double acting hydraulic cylinder having a piston and a piston rod, for increasing a rod advancing speed by transferring oil in a rod-side chamber to a piston-side chamber, comprising:

a first oil passage operatively connected to the rod-side chamber of said cylinder;

a second oil passage operatively connected with the piston-side chamber of said cylinder;

a check valve disposed in said first passage such that the return of oil from rod-side chamber is blocked;

a circulation valve disposed between said check valve and rod-side chamber of said first oil passage and said second oil passage, said circulation valve being movable between a first position where it establishes the communication between said first and second oil passages and a second position where it blocks such communication;

a spring normally biasing said circulation valve to said second position;

a pilot oil passage disposed within said circulation valve, for communicating said first oil passage, between said check valve and the rod-side chamber, with a chamber adjacent said circulation valve, for moving said circulation valve to said first position when the pressure in said first oil passage exceeds a predetermined value; and a restrictor connecting said pilot oil passage to said first oil passage at a point in said first oil passage, opposite from said rod-side chamber with respect to said check valve, for bypassing said check valve.

* * * * *